US007475475B2

(12) United States Patent
Sullivan

(10) Patent No.: US 7,475,475 B2
(45) Date of Patent: Jan. 13, 2009

(54) LOW-IMPACT INSERTION OF INSULATED WIRES INTO INSULATION DISPLACEMENT TYPE CONNECTORS

(76) Inventor: Robert W. Sullivan, 3310 Los Nogales Rd., Simi Valley, CA (US) 93063

( * ) Notice: Subject to any disclaimer, the term of this patent is extended or adjusted under 35 U.S.C. 154(b) by 428 days.

(21) Appl. No.: 11/129,257

(22) Filed: May 13, 2005

(65) Prior Publication Data

US 2006/0254054 A1 Nov. 16, 2006

(51) Int. Cl.
*H01R 43/20* (2006.01)

(52) U.S. Cl. ..... 29/861; 29/882; 29/866; 29/751; 29/761

(58) Field of Classification Search ..... 29/745–751, 29/758, 278, 566.1, 33 M, 861–866, 874, 29/882; 7/107, 158; 81/177.1, 177.2, 180.1, 81/184, 463

See application file for complete search history.

(56) References Cited

U.S. PATENT DOCUMENTS 2,960,864 A * 11/1960 Watts ..... 73/862.01
3,997,956 A * 12/1976 McKee ..... 29/564.1
4,161,061 A * 7/1979 Mason et al. ..... 29/566.4
4,241,496 A 12/1980 Gregson
4,300,282 A * 11/1981 Bunyea et al. ..... 29/751
4,696,090 A * 9/1987 Gregson et al. ..... 29/566.4
5,175,921 A * 1/1993 Krietzman ..... 29/566.4
5,666,715 A 9/1997 Zoiss et al.
5,842,268 A * 12/1998 Arnfield ..... 29/566.4
5,887,333 A 3/1999 Clark et al.
6,098,275 A * 8/2000 Wuyts et al. ..... 29/741
6,601,285 B1 * 8/2003 Jonker et al. ..... 29/566.4
6,785,950 B1 9/2004 Scirbona et al.
7,024,746 B2 * 4/2006 Weeks et al. ..... 29/407.08
7,266,878 B1 * 9/2007 Sullivan ..... 29/566.4

* cited by examiner

*Primary Examiner*—Minh Trinh
(74) *Attorney, Agent, or Firm*—Gene W. Arant

(57) ABSTRACT

Force is manually applied through a compression spring mechanism to a tool member, which in turn carries the end of an insulated wire that is to be seated between the knives of an insulation displacement type connector. A force transducer is used to measure the spring force within the compression spring mechanism, so that seating of the conductor in the connector can be accomplished without any abrupt impact.

5 Claims, 6 Drawing Sheets

LOW-IMPACT INSERTION OF INSULATED WIRES INTO INSULATION DISPLACEMENT TYPE CONNECTORS

PRIORITY CLAIM

Field of The Invention

This invention relates to making electrical wiring connections in telecommunication connector blocks or terminals.

PRIOR ART

Prior Art. U.S. Pat. Nos. 3,708,852, 4,161,061 and 4,241,496, issued in 1980 and earlier years show a tool system that includes a hand-operated tool for creating an impact. The impact tool in turn drives a wire termination tool for first positioning a conductor wire within a connector, and which also carries a cutting blade for then cutting off a protruding end of the conductor wire. More specifically, the prior impact tools were adapted to select either a high level or a low level of impact to be delivered to the wire termination tool.

BACKGROUND OF THE INVENTION

Conductor wire and circuit board. Since before 1980 technicians installing telephone and data circuits have terminated the ends of insulated wires in circuit boards having connectors of the insulation displacement type. Connectors of that type have electrical contact members which form a pair of blade-like cutting edges occupying a common plane with a V-shaped space between them. When the end of an insulated conductor wire is pushed down between the blade-like members, their sharp cutting edges cut through the insulation and sufficiently into the metal that the circuit board contact is then in electrically conductive engagement with the conductor wire. At the same time, some insulation surrounding the contact area is purposely left in place to protect the contacts against moisture.

Wire Termination Tool. It is standard practice to use a wire termination tool, which has a metal tool body that also carries a blade both for inserting the wire end between the connector contacts or alternatively for concurrently inserting the wire end between the connector contacts and cutting off a protruding end of the conductor wire. One standard type of such a wire termination tool is known as a "110 Blade", and another standard type is known as a "66 Blade". While those two types of tools are somewhat differently shaped to work with differently shaped connector panels, their function is essentially the same. The conductor wire to be attached to the connection panel is placed across the front of the 110 Blade or 66 Blade termination tool. The wire termination tool is then driven forward to insert the conductor wire between corresponding insulation displacement knife blade contacts and to seat the wire or to optimally seat the wire and concurrently cut off a protruding end of the wire.

Impact Driver or Punch-Down Tool. It has also been standard industry practice to use a hand-operated impact driver or punch-down tool for driving either a 110 Blade or a 66 Blade. The hand-operated driver or impact tool has a housing for slidably receiving the termination tool. The termination tool, whether a 110 Blade, 66 Blade, or other industry standard type blade, is slidably mounted within or upon the driver. The punch-down or impact driver tool contains an internal spring which becomes compressed when the tradesman or technician applies hand force. A factory setting on the impact tool allows a selection to be made of either a high or a low level of impact force.

Compression Spring Drive Action. A forward end of the conductor wire to be inserted into the connector panel is placed across the forward end of the wire termination tool. The forward or output end of the compression spring bears against the 110 Blade Tool, 66 Blade Termination Tool, or other industry standard termination tool. The technician or tradesman pushes the impact tool forward, and when the pre-set force level is reached a trigger associated with the spring then automatically releases the spring compression. The stored energy of the compression spring then drives the 110 or 66 Blade or other standard tool forward to insert the conductor wire into the connector of the circuit panel. At this time the technician or tradesman should be holding the impact tool steady, so as to achieve the exact impact for which the pre-set spring compression was selected. Typically, although not necessarily, the forward movement of the termination tool also concurrently cuts off a protruding end of the wire, by means of a cutting blade carried on the tool.

Abrupt release. Thus according to standard practice a spring that is manually compressed to a predetermined level is abruptly released by a mechanical trigger to drive the termination tool. The release of the spring force and its resulting momentum will then drive the termination tool member forward to seat the conductor wire within the connector and also to cut off its protruding end.

Optimum Contact. In the typical connectors of the insulation displacement type the pair of knife blades that achieve the electrical contact with a conductor wire inserted between them have certain characteristics. The blades are not entirely stiff and immobile, but are so constructed as to have a certain amount of spring action. Their configuration provides an optimum location where is it preferred to have the conductor lodge. This may be referred to as a "sweet spot". But if a conductor wire is not inserted far enough to reach the "sweet spot" the electrical contact may be inferior. And if the conductor wire is pushed too far there may be significant damage to the connector or to the panel on which it is mounted. Desired product design is such that if a conductor is correctly inserted at the "sweet spot" it should be possible to remove that conductor and insert a different one, for dozens or perhaps hundreds of times, without damage to the connector panel. In some installations the conductor wire is electrically connected to the panel but does not need to be cut off, and remains an active electrical conductor in both directions from the connector panel.

SUMMARY OF THE PRESENT INVENTION

Method. According to the present invention there is no abrupt force applied against the wire termination tool. I use an entirely different method of storing energy in the spring, and releasing its stored energy to seat the conductor wire within the connector. As before, a conductor wire to be attached to the connection panel is placed in front of and across the end of the termination tool. I also use a compression mechanism within a hand-operated driver to drive the wire termination tool forward. But my hand-operated driver generates a steadily increasing force rather than an abrupt impact. As the operator uses the force of his or her hand to increasingly compress the spring mechanism, the spring force continuously presses against the termination tool until the conductor is seated within the connector blades.

Conductor Wire Insertion. The wire termination tool drives the conductor wire down between the knife blades of the circuit panel; causes the insulation displacement knife blades to cut through the insulation on the wire; and also causes those knife blades to cut into the metal enough to establish electrical contact. The level of compression force within the spring rises because of back resistance from the knife blades of the connector when the conductor is to be inserted between them. At the same time, more or less concurrently, the blade edge carried on the forward end of the wire termination tool cuts off an end portion of the conductor wire that protrudes beyond the connector.

Operation Control. According to my method there are several different ways in which the operator or technician can determine and control the best time to stop applying the hand force. One way is to watch the conductor wire until its protruding end falls off, and then stop applying force. Another way is to use instrumentation that continuously indicates to the operator the level of force that is then being applied. A third way is to provide instrumentation that responds to a pre-set level of force to indicate to the operator that the desired pre-set force level has been reached.

Apparatus. Apparatus to carry out my method includes a hand tool with a housing for slidably receiving a wire insert tool, and a spring mechanism that responds to continuously increasing pressure on the housing to compress the spring mechanism and therefore drive the wire insert tool forward. The apparatus may also include a means to measure and indicate the level of driving force achieved by the compression spring. I prefer to include an indicator electrically operated by a battery.

Precise Cutting Blade. I prefer to use a cutting blade made of a good grade of tool steel, such as described in my prior copending patent application entitled WIRE END INSERT TOOL WITH REPLACEABLE CUTTING BLADE, Ser. No. 10/836,508 filed Apr. 29, 2004; and my prior copending United States application entitled WIRE END INSERT 66 TOOL WITH REPLACEABLE CUTTING BLADE, Ser. No. 11/117,049 filed Apr. 29, 2005. That new technology is expected to provide sharper cutting edges and permit greater precision in the operation of this kind of apparatus. The improved cutting action of the blade requires a lower amount of force to cut the protruding end of the conductor wire than has heretofore been required by the standard wire insert tools.

Feasibility of Method. My method is feasible because an insulated conductor wire is usually composed of two materials; an outer polymer insulator and an inner diameter of copper, both of which are relatively soft and rather easy to cut. The connector block and its associated circuitry usually contain copper, thin plastic, and fiberglass materials that would be easily damaged, thus establishing a need for greater precision in inserting a conductor wire into the connector.

DRAWING SUMMARY

FIG. 1(*a*) is a fragmentary view showing a conductor wire that is being seated within a pair of contact knives which have cut through the insulation and into the metal core;

FIG. 2(*a*) is like FIG. 1(*a*);

Figures 2, 2A:
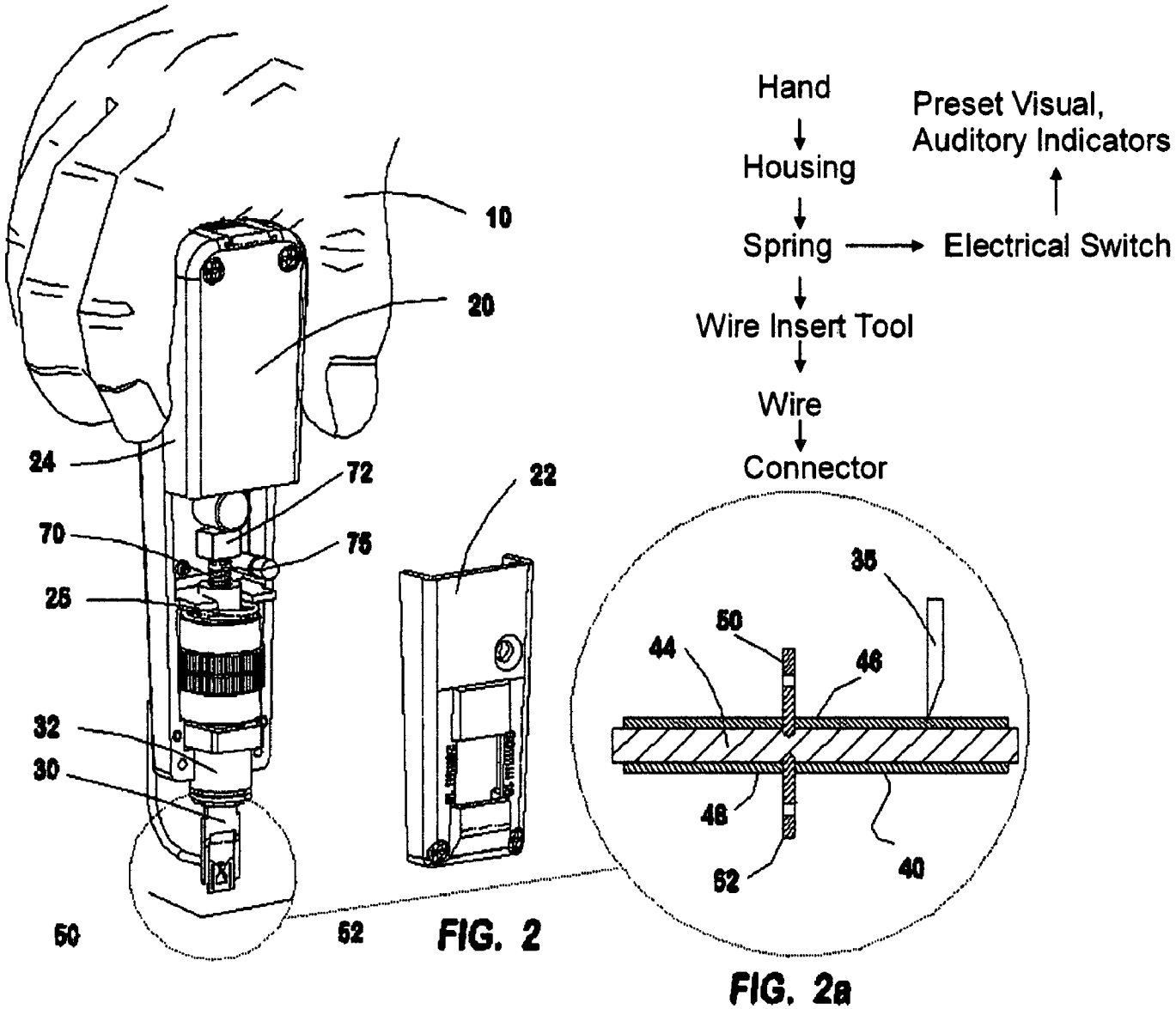
FIG. 2 is like FIG. 1 except that the tool system contains an electrical switch to produce an output signal when a pre-set level of spring compression force is reached.
Figures 3A, 3B, 3C:
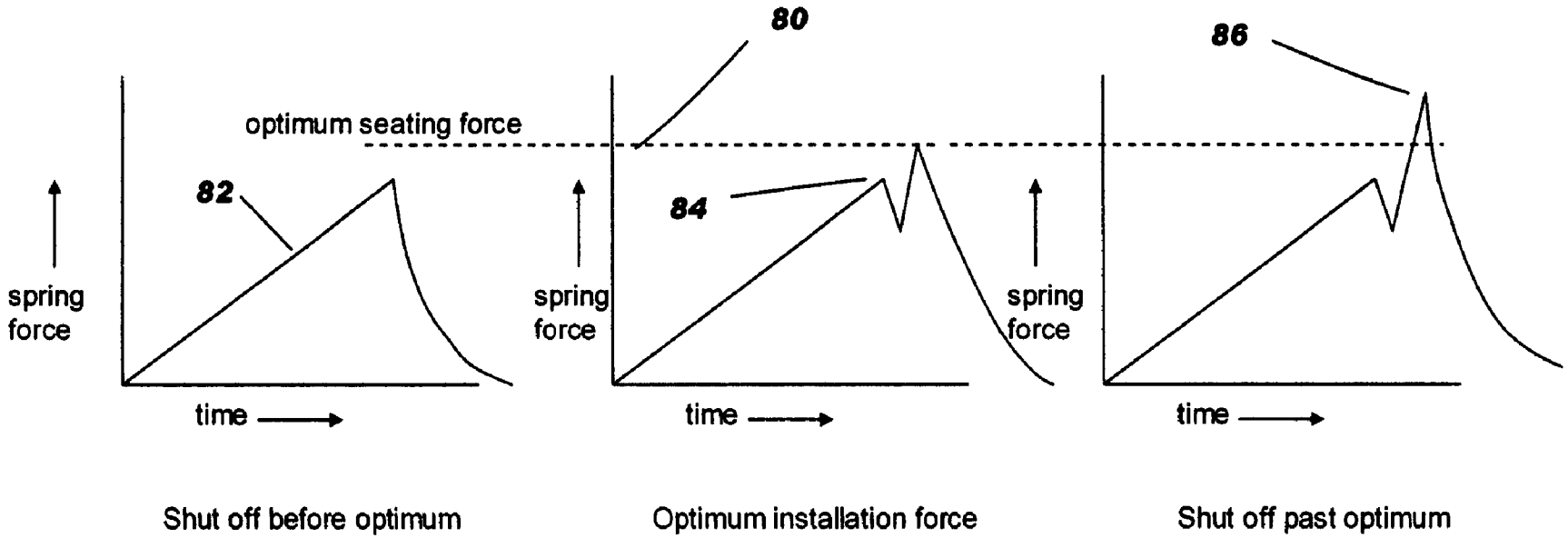
Figure 4:
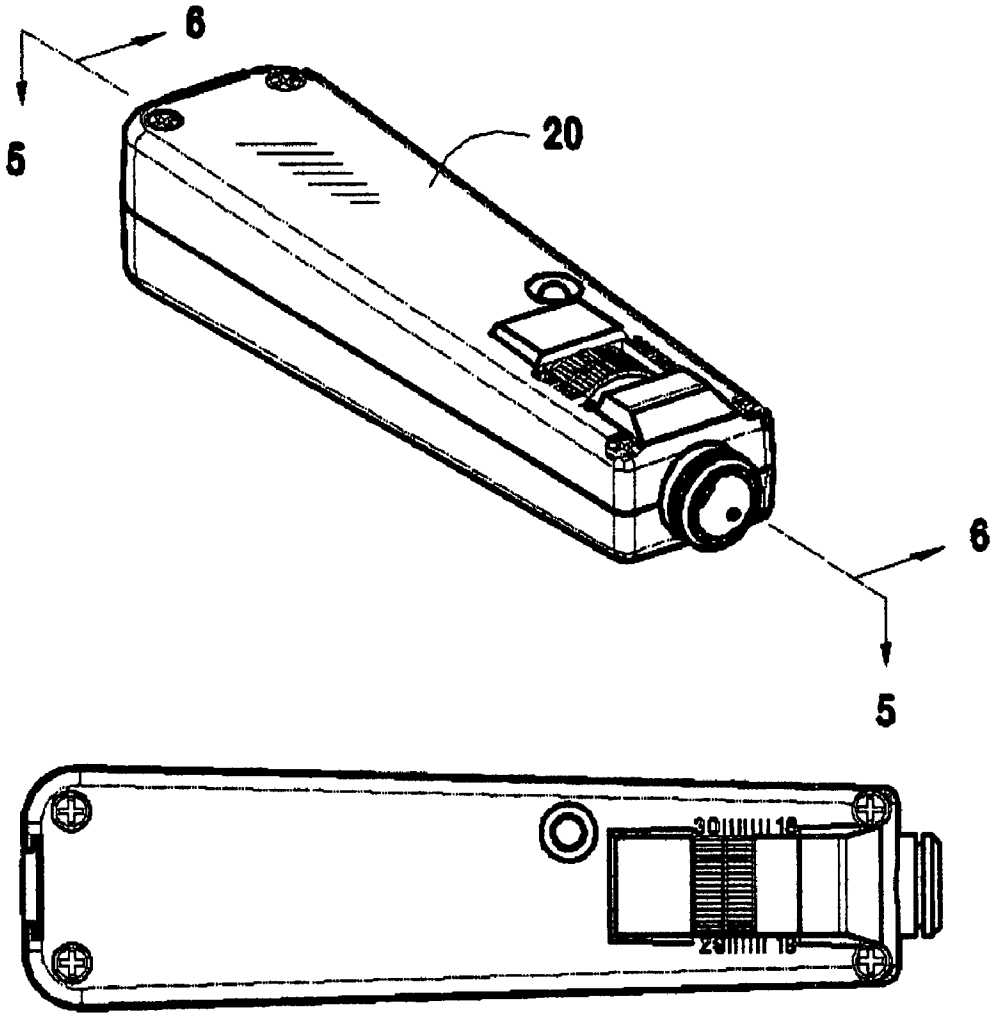
Figure 5:
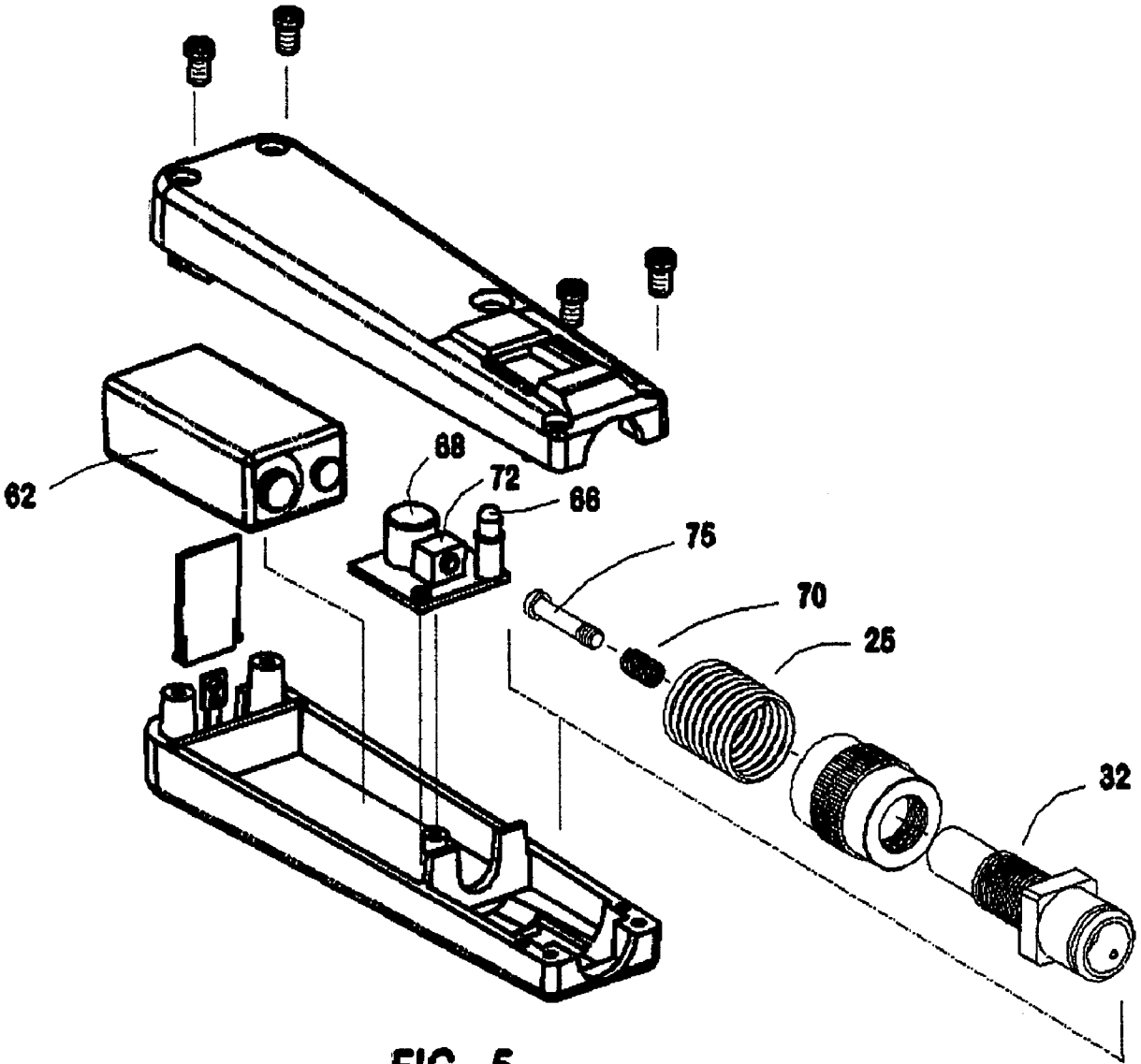
Figure 6:
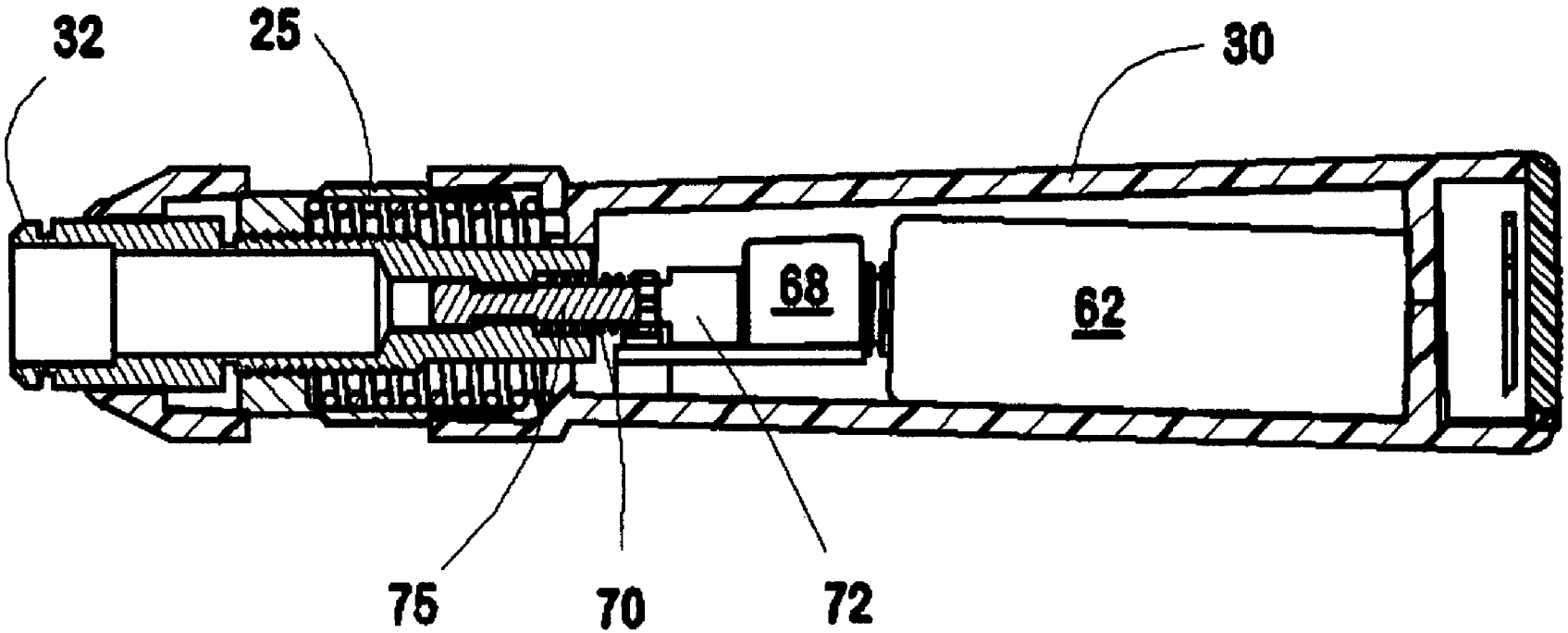

FIGS. 3(*a*), 3(*b*), and 3(*c*) show a build-up of the spring compression force over time, and how the compression force may change as the insulation on the conductor is being cut and the application of hand force is discontinued;

FIG. 4 includes a top plan view and a perspective view of the tool system of FIG. 2;

FIG. 5 is an exploded view taken on line 5-5 of FIG. 4 showing the components of the tool system of FIG. 2; and FIG. 6 is a cross-sectional view taken on the line 6-6 of FIG. 4 showing internal construction of the hand-operated tool of FIG. 2.

DETAILED DESCRIPTION

Figures 1, 1A:
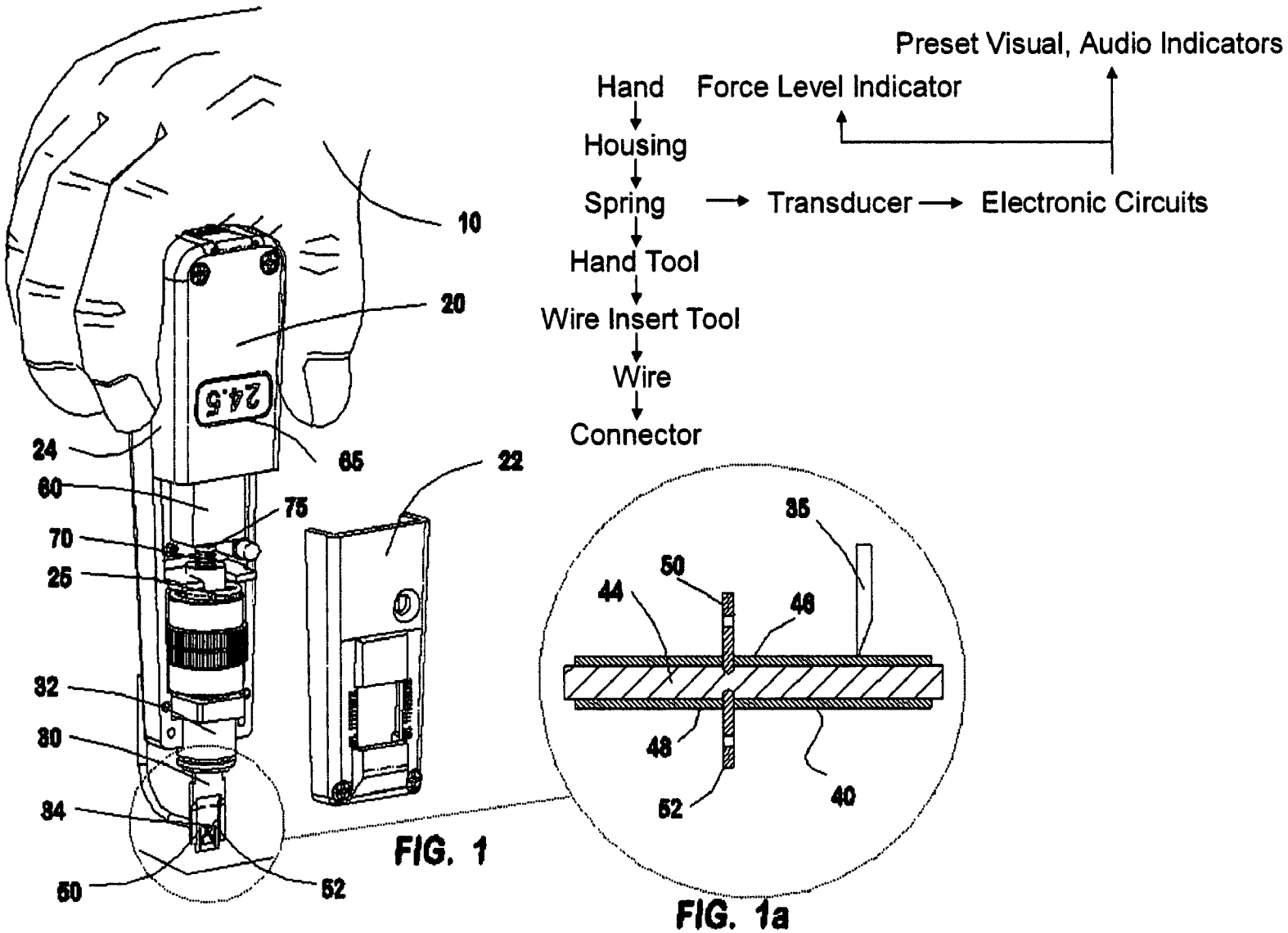
FIG. 1 is a partially exploded elevation view of a tool system used for carrying out the method of my invention, including a transducer employed to provide a continuous readout of the spring force level; and also schematically showing the sequence of steps of the process.

[FIGS. 1, 1(*a*), 3(*a*), 3(*b*), and 3(*c*)]

Referring now to FIG. 1, the operator's hand 10 is shown grasping hand-operated driver 20 by means of surface 24 of its housing 22. Wire insert tool 30 is an elongated tool member having a mounting block 32, and a positioning and cutting end 34 for engaging an insulated conductor wire 40. In accordance with the standard technology, hand-operated driver 20 has a receiving chamber, not specifically shown, for slidably receiving mounting block 32 of tool member 30. Hand-operated driver 20 supports tool member 30 in longitudinally slidable relation therewith.

A compression mechanism or spring 25 is received within the housing 22 of hand-operated driver 20 to drivingly engage the wire insert tool 30. The insulated conductor wire 40 is placed across forward end 34 of wire insert tool 30 and underneath its cutting blade 35. When the operator by hand 10 forces the driver 20 forward, the compression spring or mechanism 25 within the receiving chamber of the hand-operated driver 20 drivingly engages the tool member 30. Continued pressure by the operator on housing 22 of driver 20 forces the compression spring 25 to raise its energy level while maintaining engagement of the spring with the wire insert tool member 30. A battery 62, shown only in FIG. 5, energizes transducer 60 to measure and indicate force level.

As shown in FIG. 1 the force transducer 60 has an electronic readout 65. This provides a visual indication to the operator of the actual compression spring force level as hand force is being increased. This indication will enable the operator to more correctly and precisely control the process of wire insertion and/or wire cutting as the process proceeds.

The invention makes it possible to continuously monitor the applied force level through the force transducer 60 with electronic readout 65. When a desired force level has been reached or is closely approached the electronic circuits associated with the transducer 60 may make a sound, or generate a light or other signal signal or indicator. The monitoring apparatus may be pre-set to a desired force level so that the operator is alerted at exactly the optimum moment of time. The operator may also observe a protruding end of the conductor wire falling off, to then know to stop increasing the force he or she applies to the punch-down tool.

As most clearly shown in FIG. 1(*a*), the insulated conductor wire 40 has a metal wire core 44 with insulation layers 46, 48, above and below the core. The knife blades 50, 52 of an insulation displacing type connector receive the conductor 40 and cut through the respective insulation layers 46, 48, while also biting into the metal core 44 sufficiently to create a good electrical connection. Cutting blade 35 carried on the forward end 34 of tool 30 is also partially shown in FIG. 1(*a*); and solely for convenience of illustration is shown in a position rotated ninety degrees about the axis of conductor 40.

FIG. 3(*a*) indicates that there is an optimum level 80 of compression spring force for the optimum seating of conductor 40 in the connector. Spring force level 82 rises over time as the operator's hand continues to press housing 22. As shown in FIG. 3(*b*) there may be a force level 84 which is below the optimum level 80, which is reached before the knife blades 50, 52 cut through the insulation layers. There may then be a small drop in the spring force level. Then the continued application of force may raise the spring force level 82 all the way to the optimum level 80 as the conductor core 40 becomes seated within the "sweet spot" in the connector blades. At the same time, the protruding end of the wire 40 may be cut off.

FIG. 3(*c*) illustrates a possible situation in which hand pressure on the driver 20 has been continued too long, failing to stop the pressure at the optimum moment, so that spring force level 82 rises to a level 86 that is above the optimum level 80. That excessive pressure may cause damage to the connector. The illustration of FIG. 3(*c*) may also represent a situation in which the parameters of the connector blades and an anvil associated with them are such that the conductor 40 must necessarily be inserted beyond the "sweet spot" in the connector blades before its core 40 can be cut off on the anvil, when that is part of the process.

The present invention is primarily directed to the wire insertion process, which may not necessarily be accompanied by a cutting off of the inserted conductor wire. The illustrations of FIGS. 3(*a*), (*b*), and (*c*) do not necessarily reflect operational results, but serve to indicate that precise control of the wire insertion operation is critical. Those diagrams are provided mainly to facilitate a discussion of the process.

DETAILED DESCRIPTION

[FIGS. 2, 2(*a*), 4, 5, and 6]

According to my invention my punch-down tool includes means for setting a pre-selected level of force, chosen from a wide range of force levels, at which the operator will be automatically signaled to terminate the application of hand force to the tool. The embodiment of FIG. 1 provides a continuous readout on readout device 65 of the force level then being applied, to facilitate achieving the optimum insertion force level without damage to the The components of the tool system of FIG. 2 are best seen in the exploded view of FIG. 5.

As shown in FIG. 5, a small spring 70 whose movement is controlled by expansion of the spring mechanism 25 also bears against a bolt or screw 75. The position of device 75 may be adjusted to correspond to a desired pre-set level of driving force. When the compression level in the compression spring mechanism 25 reaches the pre-set level the bolt or screw 75 then turns on LED actuation switch 72, which in turn causes an LED 66 to become energized, which in turn drives a buzzer or sound generating signal device 68. Thus, the tradesman or technician may advantageously adjust the operation of the driver 20 to match the particular physical parameters of the circuit panel, connector knife blades, and conductor 40, with which the tradesman or technician is dealing at the time.

Coordination of Functions

Although one standard industry practice heretofore has included cutting off a protruding end of the inserted conductor wire at the same time that it is being seated in the connector, another and separate procedure could perhaps be employed for that purpose. In some installations the conductor wire is electrically connected to a connector panel but does not need to be cut off, and remains an active electrical conductor in both directions from the connector panel.

In recent years the deregulation of the industry has allowed many manufacturers to make all of the relevant products—the circuit panels, the insulated conductors attached to the panels, and the tools for accomplishing the attachment—to different technical standards. Due to differences in the standards of the products of different companies the previously established industry standards are no longer reliable. The present invention is mainly directed to obtaining precise results in the insertion of conductor wires into a circuit panel of the insulation displacement type. The force level required for cutting off the end of a conductor wire may be somewhat greater or somewhat less than the force level required to insert that wire between a pair of contact knives. If too low a spring compression level is used, the conductor wire may not become conductively seated to the full extent that is desired. If too high a compression level is used, there is a danger that the delicate mechanism of the connection panel circuit board may be damaged. Neither is desirable. For a particular connector and particular wire type the optimum force level that would be needed to seat the conductor wire properly within the contacts of the connector panel can be determined with reasonable accuracy. For a particular connector and particular wire type the force level that would be required to cut off the protruding wire end can also be determined with reasonable accuracy. Utilizing my new method, it is possible to coordinate those two functions in an efficient manner.

If desired, my instrument system may be equipped to record the force levels actually reached when a cutting action occurred. In that manner, the tradesman or technician can more efficiently predict what will be required on the next step of the same job. A desired predetermined level of the output force may be programmed into the hand tool, and an audible, visual, or other indicating means may be provided to inform the tradesman or technician either when that level is being approached or when it has been reached.

Although the presently preferred forms of my invention have been disclosed herein, it will be understood that other modifications should be apparent to those skilled in the art, and that the scope of my invention is to be judged only by the appended claims.

PARTS LIST

10 Operator's hand
20 Hand-operated tool or driver
  22 housing
  24 Grasping surface
25 Compression spring
30 Wire Inset Tool
  32 mounting block of 30
  34 forward end; positioning and cutting end for engaging the insulated wire;
  35 cutting blade on forward end 34 of 30
40 insulated conductor wire
  metal wire core 44
  insulation layers 46, 48
50, 52 Knife Blades of Connector
60 Transducer
62 battery
65 Electronic Readout (FIG. 1)
70 small spring (FIG. 2)
72 LED actuation switch
75 adjustable switch actuation screw
66 LED
68 Buzzer
80 optimum level of spring force for wire seating
82 spring force as a function of time
84 max pressure before insulating cutting commences
86 still higher spring force, damaging panel

What I claim is:

1. The method of repetitively accomplishing a mechanical action of a tool member for securing insulated conductors in insulation displacement type connectors of a connector panel, comprising the steps of:

(a) drivingly engaging the tool member with one end of a compression spring while also engaging one conductor with the tool member;

(b) manually applying incrementally increasing force to the other end of the compression spring until the conductor is secured within a connector of the connector panel;

c) continuously electronically monitoring the force level existing within the compression spring while its force is being applied to the tool member;

(d) when the one conductor has been secured in one connector of the connector panel, recording the force level that then existed within the spring; and (e) to secure another conductor within another connector of the same panel, repeating the process until force at the previously recorded level of force is applied to the other end of the compression spring.

2. The method of claim 1 wherein the force level within the compression spring is measured by a force transducer.

3. The method of claim 1 wherein the measured force level is electronically visibly displayed.

4. The method of claim 1 wherein, during the repetitive application of the compression spring to the tool member, the previously recorded level of force is visibly displayed.

5. The method of claim 1 wherein, during the repetitive application of the compression spring to the tool member, a sound is generated when the previously recorded level of force within the compression spring is again reached.

* * * * *